US005125418A

United States Patent [19]

Siems

[11] Patent Number: 5,125,418

[45] Date of Patent: Jun. 30, 1992

[54] METHOD OF AND APPARATUS FOR GENERATING ELECTRIC SIGNALS DENOTING THE MASS FLOW OF FIBROUS MATERIAL IN A STREAM

[75] Inventor: Wolfgang Siems, Hamburg, Fed. Rep. of Germany

[73] Assignee: Korber AG, Hamburg, Fed. Rep. of Germany

[21] Appl. No.: 725,645

[22] Filed: Jul. 3, 1991

[30] Foreign Application Priority Data

Jul. 21, 1990 [DE] Fed. Rep. of Germany ..... 4023225

[51] Int. Cl.[5] ..... A24C 5/14

[52] U.S. Cl. ..... 131/84.1; 131/84.4; 131/906; 324/640

[58] Field of Search ..... 131/904, 906, 84.1–84.4, 131/108, 109.1; 324/655, 640

[56] References Cited

U.S. PATENT DOCUMENTS

| | | | |
|---|---|---|---|
| 2,979,581 | 8/1948 | Ballou | 200/42 |
| 4,185,644 | 1/1980 | Heitmann | 131/109 R |
| 4,280,516 | 7/1981 | Reuland | 131/906 X |
| 4,283,998 | 8/1981 | Greve | 493/4 |
| 4,475,080 | 10/1984 | Walker | 324/640 |
| 4,651,755 | 3/1987 | Rudszinat | 131/84.4 |
| 4,805,641 | 1/1989 | Radzio | 131/280 |
| 4,865,054 | 9/1989 | Lorenzen | 131/280 |

*Primary Examiner*—Vincent Millin
*Assistant Examiner*—J. Doyle
*Attorney, Agent, or Firm*—Peter K. Kontler

[57] ABSTRACT

The combined mass flow of solid and liquid fractions of a fibrous material which is converted into a tobacco rod or filter rod in a rod making machine of the tobacco processing industry is ascertained by monitoring the liquid fraction in the distributor of the machine and by monitoring the solid fraction downstream of the monitoring station for the liquid fraction. Electric signals which are obtained as a result of such monitoring are processed in a computer which transmits a signal denoting the combined mass flow of solid and liquid fractions. Such signal is used to maintain the combined mass flow at or close to a preselected value, particularly by adjusting a trimming device which removes the surplus of fibrous material ahead of the station where the fibrous material is draped into a web of cigarette paper, imitation cork or other wrapping material.

21 Claims, 1 Drawing Sheet

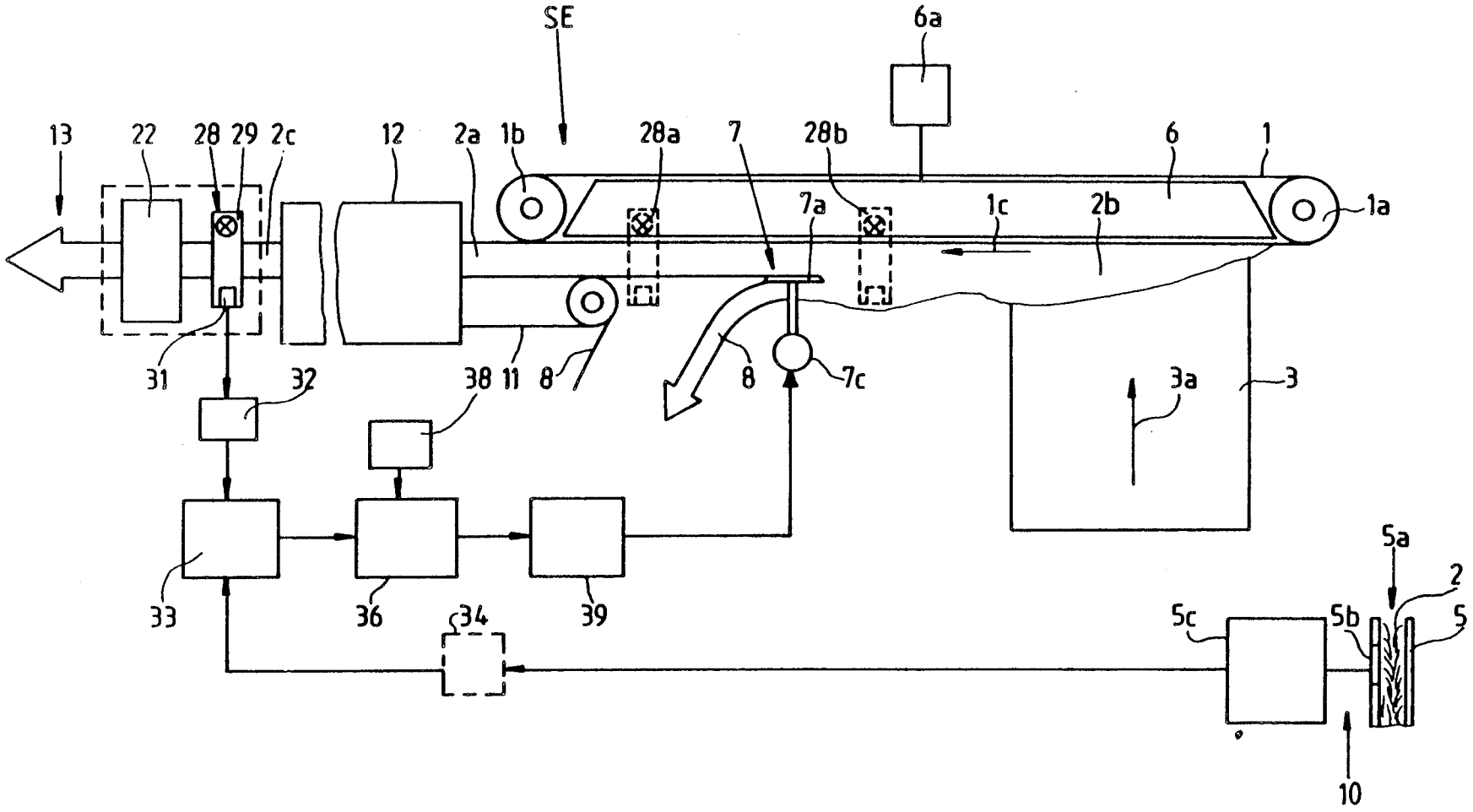
1a
1
6
2b
1c
6a
28b
7a
7
28a
SE
1b
2a
12
2c
29
28
22
13
3
3a
7c
8
8'
11
38
32
31
39
36
33
34
2
5
5a
5b
5c
10

METHOD OF AND APPARATUS FOR GENERATING ELECTRIC SIGNALS DENOTING THE MASS FLOW OF FIBROUS MATERIAL IN A STREAM

BACKGROUND OF THE INVENTION

The invention relates to a method of and to an apparatus for generating electric signals which are indicative of one or more parameters of a flow of comminuted material, and more particularly to a method of and to an apparatus for generating electric signals which denote the mass flow of fibrous material in a rod making machine of the tobacco processing industry.

Fibrous materials which can be monitored in accordance with the method and in the apparatus of the present invention include fragments of natural, reconstituted and/or substitute tobacco, or filaments or other forms of fibers which can be used as filters for tobacco smoke. Such fibrous materials are normally processed in so-called rod making machines, including machines for the making of cigarettes or other rod-shaped smokers' articles and machines for the making of rod-shaped filters which can be subdivided into filter rod sections of desired length.

Fibrous material which is to constitute the rod-like filler of a cigarette, cigar, cigarillo, cheroot or another rod-shaped smokers' product, or the material which is to constitute the rod-like filler of a filter for tobacco smoke, contains two constituents or fractions, namely a solid fraction and a liquid fraction. The solid fraction consists of dry tobacco and additives (such as flavoring agents) or of solid filter material, and the liquid fraction normally contains or consists of water. The liquid fraction of fibrous material which is to be converted into the filler of a filter rod can also contain one or more liquid chemicals, e.g., softening agents (such as triacetin).

It is already known to ascertain the entire mass flow of a tobacco stream or filter stream (hereinafter referred to as tobacco stream with the understanding, however, that the same procedure can be resorted to for the monitoring of streams which contain filter material for tobacco smoke), e.g., by resorting to X-rays, to beta rays or to other penetrative radiation. The intensity of radiation which has penetrated through the fibrous material is monitored for the purpose of generating a signal which can be utilized to adjust the mass flow of tobacco if the intensity of the thus ascertained signal departs from a preselected optimum value.

It is further known to ascertain the moisture content of a tobacco stream and to process the resulting signal with the signal denoting the entire mass flow of the stream in order to ascertain the mass flow of solid fraction of the tobacco stream. The thus obtained signal can be utilized to regulate the formation of a rod-like tobacco filler for the purpose of maintaining the mass flow of the solid fraction at a substantially constant value.

Thus, in order to obtain a signal which is indicative of the mass flow of solid fraction of a tobacco stream, it is necessary to resort to a source of penetrative radiation (which can be put to use only by observing numerous stringent regulations concerning the utilization of X-rays, beta rays or similar rays), and it is thereupon necessary to process the thus obtained signals with signals denoting the mass flow of the liquid fraction in order to obtain a signal which can be said to denote the mass flow of solid fraction of the tobacco stream.

OBJECTS OF THE INVENTION

An object of the invention is to provide a simple, inexpensive and reliable method of ascertaining the combined mass flow of fibrous material in a rod making machine of the tobacco processing industry.

Another object of the invention is to provide a novel and improved method of generating signals which can be utilized to maintain the combined mass flow of solid and liquid fractions of a stream of fibrous material in a rod-making machine of the tobacco processing industry at a substantially constant value.

A further object of the invention is to provide a method which can be practiced without resorting to dangerous penetrative radiation.

An additional object of the invention is to provide a novel and improved method of making a superior rod-like filler of tobacco or filter material for tobacco smoke.

Still another object of the invention is to provide a novel and improved apparatus for the practice of the above outlined method.

A further object of the invention is to provide a rod making machine which embodies the above outlined apparatus.

Another object of the invention is to provide the apparatus with novel and improved means for generating signals which can be utilized to regulate the quality of the rod-like filler in a rod making machine of the tobacco processing industry.

An additional object of the invention is to provide novel and improved combinations of monitoring means for use in the above outlined apparatus.

Another object of the invention is to provide novel and improved means for adjusting the trimming or equalizing device in a cigarette rod making machine.

A further object of the invention is to provide a novel and improved operative connection between the trimming device and the monitoring means for a stream of fibrous material in a rod making machine of the tobacco processing industry.

SUMMARY OF THE INVENTION

One feature of the present invention resides in the provision of a method of producing signals which denote the mass flow of fibrous material in a rod making machine of the tobacco processing industry wherein the fibrous material contains a solid fraction (e.g., natural, reconstituted or substitute tobacco or filter material for tobacco smoke) and a liquid fraction (such as water). The method comprises the steps of conveying fibrous material along a predetermined path, monitoring the material in the path and generating a first electric signal which denotes the mass flow of the solid fraction, monitoring the material in the path and generating a second signal which denotes the mass flow of the liquid fraction, and converting (e.g., in a computer) the first and second signals into a third signal which denotes the combined mass flow of the solid and liquid fractions.

The conveying step can include accumulating a stream of fibrous material, and at least the first monitoring step can include monitoring the material of the stream for the purpose of generating the first signal.

The first monitoring step can include directing light against fibrous material in at least one portion of the path so that a certain amount of directed light penetrates through the fibrous material. The step of generating the first signal then comprises generating a signal which is indicative of the amount of radiation that has penetrated through the fibrous material in the at least one portion of the path. Light which is directed against the fibrous material can have a wavelength in the range of 850 to 910 nm, particularly approximately 880 nm.

The second monitoring step can include conveying fibrous material through an electric high-frequency field which is damped by the liquid fraction of fibrous material The step of generating the second signal then includes generating a signal which denotes damping of the high-frequency field by the liquid fraction of conveyed fibrous material. The high-frequency field can be established and maintained by a stray-field capacitor. That portion of the path wherein the fibrous material passes through the high-frequency field can be defined by a duct, e.g., a duct wherein fibrous material descends by gravity flow.

The method can further comprise the steps of generating a fourth signal (reference signal) denoting the desired combined mass flow of fibrous material, generating a fifth signal having at least one characteristic (e.g., intensity) which denotes the difference (if any) between the third and fourth signals, and utilizing the fifth signal to influence the fibrous material so as to maintain the combined mass flow at a substantially constant value. The conveying step can include gathering fibrous material into an unequalized stream and equalizing the stream to form a stream of substantially constant cross-sectional area. The influencing step can include adjusting the equalizing step to an extent which is a function of the at least one characteristic of the fifth signal.

Another feature of the present invention resides in the provision of an apparatus for producing signals which denote the mass flow of fibrous material in a rod making machine of the tobacco processing industry wherein the fibrous material contains a solid fraction (such as natural, reconstituted and/or substitute tobacco or a material which constitutes or contains a filter for tobacco smoke) and a liquid fraction (e.g., water). The improved apparatus comprises means for conveying fibrous material along a predetermined path, first monitoring means for monitoring the material in the path and including means for generating a first electric signal which denotes the mass flow of the solid fraction, second monitoring means for monitoring the material in the path including means for generating a second electric signal which denotes the mass flow of the liquid fraction, and means (e.g., a computer) for converting the first and second signals into a third signal denoting the combined mass flow of the solid and liquid fractions. The conveying means can comprise means for accumulating a stream of fibrous material, and at least the first monitoring means can include means for monitoring the stream of fibrous material.

The means for generating a first signal can include at least one source of light which directs light against the fibrous material in the path whereby a certain amount of the thus directed light penetrates through the fibrous material in the path, and at least one photoelectric transducer which generates a first signal denoting the amount of light that penetrates through the fibrous material in the path. The at least one source can be selected to emit light having a wavelength in the range of 850 to 910 nm, preferably approximately or exactly 880 nm.

The means for generating a second signal can include an oscillator circuit having a capacitor which is arranged to subject fibrous material in the path to the action of an electric high-frequency field whereby the oscillator is damped by the liquid fraction of fibrous material in the high-frequency field, i.e., the extent of damping is indicative of the mass flow of liquid fraction in the fibrous material in the path. The conveying means can include a duct for fibrous material, and the capacitor can be disposed at the duct so that the fibrous material in the duct traverses the electric high-frequency field.

The apparatus can further comprise a signal comparing stage which is connected with the output of the converting means to receive the third signal, and a source of reference signals which denote the desired combined mass flow of the solid and liquid fractions. The source of reference signals is connected with the signal comparing stage, and the latter is designed to generate a fifth signal which denotes the difference between the characteristics of the third and reference signals. Such apparatus preferably further comprises means for influencing the fibrous material as a function of the fifth signal for the purpose of maintaining the combined mass flow at a substantially constant value. This can be accomplished, for example, by utilizing a conveying means which accumulates an unequalized stream of fibrous material and comprises or is combined with adjustable means for equalizing the stream. The influencing means can include means for adjusting the equalizing means as a function of a characteristic (e.g., intensity) of the fifth signal.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a fragmentary partly elevational and partly schematic view of a cigarette rod making machine which embodies one form of the improved apparatus, the means for monitoring the mass flow of the solid fraction of fibrous material being adjacent the path for the wrapped cigarette rod and the means for monitoring the mass flow of the liquid fraction of fibrous material being located in the distributor or hopper of the rod making machine.

DESCRIPTION OF PREFERRED EMBODIMENTS

The drawing shows a portion of a cigarette rod making machine, e.g., a machine known as PROTOS which is made and distributed by the assignee of the present application. The rod making unit SE of the machine receives fibrous material 2 (mainly or exclusively shredded tobacco) from a distributor or hopper having a gathering duct 5 wherein a column of fibrous material 2 descends by gravity (arrow 5*a*). Reference may be had, for example, to commonly owned U.S. Pat. No. 4,185,644 to Heitmann et al. The fibrous material consists of a solid fraction constituted by tobacco shreds and perhaps some fragments of tobacco ribs, and a liquid fraction in the form of moisture (water).

The means 10 for monitoring the fibrous material for the presence of liquid fraction and for generating electric signals which are indicative of the mass flow of the liquid fraction includes a stray field capacitor 5b which is built into one wall of or is adjacent the duct 5 and establishes and maintains an electric high-frequency field which is traversed and is thus influenced by the fibrous material in the duct 5. The monitoring means 10 further comprises an oscillator circuit and an evaluating circuit 5c which transmits signals denoting the moisture content of fibrous material 2 in the duct 5. The liquid fraction of the fibrous material 2 traversing the stray field of the capacitor 5b exerts a damping action which is indicative of the mass flow of liquid fraction in the fibrous material, and the signal at the output of the evaluating circuit 5c is indicative of such damping action, i.e., of the mass flow of liquid fraction in the column of fibrous material 2 descending in the direction of arrow 5a on its way through the gathering duct 5 and on toward a second duct 3 wherein the fibrous material forms a shower which is caused to rise in the direction of arrow 3a.

The capacitor 5b can be constructed and assembled in a manner as disclosed in commonly owned copending patent application Ser. No. 07/629,049 filed Dec. 14, 1990 by Dierk Schroeder et al. for "High frequency oscillatory circuit" and in the corresponding published United Kingdom application No. 2 211 618 A. The evaluating circuit 5c can be of the type described in commonly owned copending patent application Ser. No. 07/378,865 filed Jul. 12, 1989 by Norbert Hohenstein et al. for "Method of and apparatus for ascertaining a characteristic value of a high-frequency oscillator" and in the corresponding published European patent application No. 0 352 505. A highly accurate moisture measuring instrument embodying the features which are disclosed in the copending patent applications Ser. Nos. 07/378,865 and 07/629,049 is made and distributed by the assignee of the present application and is known as PROMOS.

The manner in which the fibrous material 2 advances from the duct 5 into the duct 3 is described and shown in the aforementioned U.S. Pat. to Heitmann as well as in numerous other United States and foreign patents and patent applications of the assignee of the present application. The means for conveying the fibrous material 2 along a predetermined path comprises the aforementioned ducts 5, 3 as well as an endless conveyor belt 1 which is trained over pulleys 1a and 1b. At least one of the pulleys 1a, 1b is driven in a well known manner, not shown, to advance the elongated lower reach of the belt 1 in the direction of arrow 1c. The belt 1 is foraminous and its lower reach is caused to advance beneath the perforated bottom wall of a suction chamber 6 which has at least one outlet connected to the suction intake of a suitable suction generating device 6a, e.g., a suction pump, a fan or the like.

The shower of fibrous material 2 which rises in the duct 3 in the direction of arrow 3a is attracted by suction to the underside of the lower reach of the belt 1 to form a continuous unequalized stream 2b which is advanced in the direction of arrow 1c. The height and the unevennesses of the stream 2b are exaggerated in the drawing for the sake of clarity. The belt 1 advances the stream 2b past a standard trimming or equalizing device 7 which can comprise a pair of coplanar clamping discs 7a (one shown in the drawing) defining a trimming or equalizing plane at a variable distance from the lower reach of the belt 1, and a paddle wheel or a gear (not shown) which is installed beneath the plane of the discs 7a and serves to brush off or to otherwise remove the downwardly projecting portions of particles of fibrous material forming the stream 2b. The thus equalized stream (the height of which is exaggerated in the drawing) can be said to constitute a rod-like filler 2a which is ready to be compacted or condensed and draped into a web 8 of cigarette paper or other suitable wrapping material to form with the web a continuous cigarette rod 2c. The surplus 8 of fibrous material 2 which is removed by the paddle wheel or gear of the trimming or equalizing device 7 is returned into the distributor or hopper for admission to fibrous material 2 which is delivered into the duct 5 and passes through this duct in the direction of arrow 5a. A trimming or equalizing device which can be utilized in the apparatus of the present invention is disclosed in commonly owned U.S. Pat. No. 4,651,755 granted to Rudszinat.

The wrapping mechanism 12 which is used to convert the rod-like filler or stream 2a and the web 8 of cigarette paper into a continuous cigarette rod 2c includes means for compacting or condensing the filler as well as a belt conveyor 11 (called garniture belt) which transports the rod 2c in the direction of arrow 1c toward and into a customary cutoff 22 serving to subdivide the rod 2c into plain cigarettes of unit length or multiple unit length. The cigarettes are transported (note the arrow 13) to storage, to a packing machine or to a filter tipping machine (not shown) in a manner not forming part of the present invention.

The means for adjusting the level of the trimming device 7 (i.e., for moving the clamping discs 7a toward or away from the lower reach of the belt 1) comprises a reversible electric or other suitable motor 7c, i.e., the motor 7c can adjust the trimming device 7 for the purpose of determining the combined mass flow of solid and liquid fractions of fibrous material toward and into the wrapping mechanism 12.

The manner in which one marginal portion of the web 8 of cigarette paper is coated with adhesive and the manner in which such web is thereupon treated or manipulated to form a tubular envelope around the condensed filler 2a is well known in the art of cigarette making and need not be described here. The wrapping mechanism 12 normally further comprises means for cooling or heating the adhesive-containing seam between the overlapping marginal portions of the converted cigarette paper web 8, depending upon the nature of adhesive which has been applied to the one marginal portion of the web. For example, the adhesive can be a hotmelt.

The apparatus further comprises means for monitoring the mass flow of solid fraction of the stream of fibrous material 2. In the illustrated apparatus, the monitoring means 28 is adjacent the path of the converted or processed stream 2b, namely adjacent the path of the trimmed and compacted rod-like filler within the confines of the tube (converted web 8) of the cigarette rod 2c. The monitoring means 28 comprises one or more sources 29 of light which direct light against the cigarette rod 2c so that some light penetrates through the rod-like filler (i.e., through the trimmed and condensed stream of fibrous material) and impinges upon a photoelectric transducer 31 which generates an appropriate electric signal denoting the mass flow of the solid fraction of fibrous material 2. The light source or sources 29 and the transducer (signal generator) 31 are or can be disposed at opposite sides of the corresponding portion of the path for fibrous material 2. Monitoring means which can be used to determine the mass flow of solid fraction of a fibrous material are disclosed, for example, in commonly owned U.S. Pat. No. 4,805,641 granted Feb. 21, 1989 to Radzio et al. and in commonly owned U.S. Pat. No. 4,865,054 granted Sep. 12, 1989 to Lorenzen et al. The disclosures of these patents are incorporated herein by reference, together with the disclosures of all other patents and patent applications which are listed in the present application. Reference may also be had to a measuring instrument which is made and distributed by the assignee of the present application and is known in the tobacco processing industry as IR.

It has been found that, quite surprisingly, if the light which is emitted by the source or sources 29 has a certain wavelength, particularly between 850 and 910 nanometers (nm), most preferably close to or exactly 880 nm, the characteristics (e.g., intensity) of the electric signal which is transmitted by the transducer 31 of the monitoring means 28 are dependent primarily upon the mass flow of solid fraction of fibrous material in the filler of the cigarette rod 2*c*. The signal which is generated by the transducer 31 is modified by a circuit 32.

The outputs of the transducer 31 and of the evaluating circuit 5*c* transmit the respective (first and second) electric signals to a computer 33 which converts such signals into a third signal denoting the combined mass flow of solid and liquid fractions of fibrous material in the rod 2*c*. The connection between the output of the evaluating circuit 5*c* and the corresponding input of the computer 33 can contain a suitable time delay unit 34 (e.g., a shift register) which can delay the transmission of (second signals) so that the signals which are received by the two inputs of the computer 33 are indicative of the mass flow of the solid and liquid fractions of one and the same unit length of fibrous material 2 advancing toward and through the duct 5, thereupon toward and through the duct 3, thereupon with the lower reach of the belt 1 and thereafter with the garniture belt 11 toward the cutoff 22.

The output of the computer 33 transmits the third signal (which denotes the combined mass flow of solid and liquid fractions of the fibrous material 2) to the corresponding input of a signal comparing stage 36 of any known design. Another input of the stage 36 receives fourth signals (reference signals) from a preferably adjustable source 38 of reference signals. The reference signals denote the desired or optimum combined mass flow of solid and liquid fractions in the filler of the cigarette rod 2*c*. If the intensity and/or other characteristics of the reference signals deviate from the corresponding characteristic or characteristics of the third signal from the computer 33, the stage 36 transmits a fifth signal which is amplified by an amplifier 39 and is used by the motor 7*c* to adjust the level of the trimming plane (i.e., of the plane of clamping discs 7*a* in the trimming or equalizing device 7) in a sense to ensure that the combined mass flow of solid and liquid fractions remains at least substantially constant and matches the selected desired or optimum value.

The improved apparatus can be modified in a number of ways without departing from the spirit of the invention. For example, the monitoring means 28 can be transferred to the location 28*a* or 28*b* (both indicated by broken lines) so as to ascertain the mass flow of solid fraction in the trimmed (but unwrapped) stream or filler 2*a* or in the untrimmed stream 2*b*. Analogously, the means 10 for monitoring the mass flow of liquid fraction of the fibrous material 2 need not be installed in the distributor or hopper but can be disposed at a location which is remote from the gathering duct 5. Reference may be had, for example, to U.S. Pat. No. 2,979,581 which discloses the monitoring of liquid fraction in a tobacco stream, substantially in the same way as the determination of mass flow of the solid fraction. Still further, it is possible to install the monitoring means 28 (or equivalent monitoring means) in the distributor or hopper of a cigarette rod making machine, e.g., at the duct 5.

If the fibrous material is a filter material for tobacco smoke, the rod making machine which embodies the apparatus for ascertaining the solid and liquid fractions of fibrous filter material can be of the type described and shown in commonly owned U.S. Pat. No. 4,283,998 to Greve et al.

It is presently preferred to monitor the solid fraction of fibrous material in a portion of the apparatus wherein the fibrous material is advanced in the form of a stream, and to monitor the liquid fraction of fibrous material in the distributor or hopper of a rod making machine.

The exact nature of the computer 33, which converts first and second signals into third signals denoting the combined mass flow of solid and liquid fractions of the fibrous material 2 (tobacco) or another fibrous material which is processed in a rod making machine of the tobacco processing industry, forms no part of the present invention. The same applies for the construction of the signal comparing stage 36 and of the adjusting means 7*c* for the trimming or equalizing device 7.

An important advantage of the improved method and apparatus is that the determination of mass flow of the solid and/or liquid fraction need not be carried out with monitoring means which employ sources of dangerous penetrative radiation. Furthermore, it is not necessary to directly ascertain the combined mass flow of solid and liquid fractions. The determination of combined mass flow of solid and liquid fractions is highly accurate so that it is possible to maintain the combined mass flow at or very close to a preselected optimum value. The adjustments (if and when necessary) are carried out automatically in response to signals from the signal comparing stage 36.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of producing signals denoting the mass flow of fibrous material in a rod making machine of the tobacco processing industry wherein the fibrous material contains a solid fraction and a liquid fraction, comprising the steps of conveying fibrous material along a predetermined path; monitoring the material in said path and generating a first electric signal denoting the mass flow of the solid fraction; monitoring the material in said path and generating a second signal denoting the mass flow of the liquid fraction; and converting the first and second signals into a third signal denoting the combined mass flow of the liquid and solid fractions.

2. The method of claim 1, wherein said conveying step includes accumulating a stream of fibrous material, at least said first monitoring step including monitoring the material of said stream.

3. The method of claim 1, wherein said first monitoring step includes directing light against fibrous material in at least one portion of said path so that a certain amount of said directed light penetrates through the fibrous material, said step of generating said first signal including generating a signal which denotes the amount of light that has penetrated through the material in said at least one portion of said path.

4. The method of claim 3, wherein the light which is directed against fibrous material has a wavelength of 850 to 910 nm.

5. The method of claim 4, wherein said wavelength is approximately 880 nm.

6. The method of claim 1, wherein said second monitoring step includes conveying fibrous material through an electric high-frequency field which is damped by the liquid fraction, said step of generating said second signal including generating a signal which denotes damping of the high-frequency field by the liquid fraction of fibrous material.

7. The method of claim 6, wherein said second monitoring step includes conveying fibrous material through an electric high-frequency field which is established and maintained by a stray-field capacitor.

8. The method of claim 6, wherein a portion of said path is defined by a duct and said high-frequency field is traversed by fibrous material which is conveyed through the duct.

9. The method of claim 1, further comprising the steps of generating a fourth signal which denotes the desired combined mass flow of fibrous material, comparing the third and fourth signals, generating a fifth signal having at least one characteristic denoting the difference between the third and fourth signals, and utilizing the fifth signal to influence the fibrous material so as to maintain the combined mass flow at a substantially constant value.

10. The method of claim 9, wherein said conveying step includes gathering fibrous material into an unequalized stream and equalizing the stream, said influencing step including adjusting the equalizing step to an extent which is a function of the at least one characteristic of the fifth signal.

11. Apparatus for producing signals denoting the mass flow of fibrous material in a rod making machine of the tobacco processing industry wherein the fibrous material contains a solid fraction and a liquid fraction, comprising means for conveying fibrous material along a predetermined path; first means for monitoring the material in said path, including means for generating a first signal denoting the mass flow of the solid fraction; second means for monitoring the material in said path, including means for generating a second signal denoting the mass flow of the liquid fraction; and means for converting the first and second signals into a third signal denoting the combined mass flow of the solid and liquid fractions.

12. The apparatus of claim 11, wherein said conveying means comprises means for accumulating a stream of fibrous material and at least said first monitoring means includes means for monitoring the stream of fibrous material.

13. The apparatus of claim 11, wherein said means for generating a first signal includes at least one source of light which directs light against the fibrous material in said path whereby a certain amount of directed light penetrates through the fibrous material, and at least one photoelectric transducer which generates a first signal denoting the amount of light which penetrates through the fibrous material in said path.

14. The apparatus of claim 13, wherein said at least one source emits light having a wavelength in the range of 850 to 910 nm.

15. The apparatus of claim 14, wherein said wavelength is approximately 880 nm.

16. The apparatus of claim 11, wherein said means for generating a second signal includes an oscillator circuit including a capacitor which is arranged to subject fibrous material in said path to the action of an electric high-frequency field whereby the oscillator is damped by the liquid fraction of fibrous material in said field.

17. The apparatus of claim 16, wherein said conveying means includes a duct for fibrous material and said capacitor is disposed at said duct so that the fibrous material in the duct traverses the electric high-frequency field.

18. The apparatus of claim 11, further comprising a signal comparing stage connected with said converting means to receive the third signal, a source of reference signals denoting the desired combined mass flow of the solid and liquid fractions, said source being connected with said stage and said stage comprising means for generating a fifth signal denoting the difference between the characteristics of said third and reference signals, and means for influencing the fibrous material as a function of said fifth signal so as to maintain the combined mass flow at a substantially constant value.

19. The apparatus of claim 18, wherein said conveying means includes means for accumulating an unequalized stream of fibrous material and adjustable means for equalizing the stream, said influencing means including means for adjusting said equalizing means as a function of the characterisitc of the fifth signal.

20. The apparatus of claim 11, wherein the fibrous material contains natural, reconstituted and/or substitute tobacco.

21. The apparatus of claim 11, wherein the fibrous material contains a filter material for tobacco smoke.

* * * * *